US008452041B2

(12) United States Patent
Nedelcu

(10) Patent No.: US 8,452,041 B2
(45) Date of Patent: May 28, 2013

(54) OPPOSING DUAL-VENTED WOOFER SYSTEM

(76) Inventor: Eugen Nedelcu, Meridian, ID (US)

( * ) Notice: Subject to any disclaimer, the term of this patent is extended or adjusted under 35 U.S.C. 154(b) by 140 days.

(21) Appl. No.: 13/050,745

(22) Filed: Mar. 17, 2011

(65) Prior Publication Data

US 2012/0237077 A1 Sep. 20, 2012

(51) Int. Cl.
*H04R 9/022* (2006.01)
*H04R 9/02* (2006.01)

(52) U.S. Cl.
CPC ..... *H04R 9/022* (2013.01); *H04R 9/025* (2013.01)
USPC ..... 381/397; 381/401; 381/412

(58) Field of Classification Search
USPC ..... 381/396, 397, 407, 412, 413, 420–422, 381/433; 181/150, 198, 199
See application file for complete search history.

(56) References Cited

U.S. PATENT DOCUMENTS

| | | | |
|---|---|---|---|
| 1,568,589 | A | 1/1926 | Eddington |
| 1,637,322 | A | 7/1927 | Weil |
| 1,772,645 | A | 8/1930 | Stevens |
| 2,790,164 | A | 4/1957 | Oberg |
| 3,108,653 | A | 10/1963 | Valldeperas |
| 3,918,551 | A | 11/1975 | Rizo-Patron |
| 3,993,162 | A | 11/1976 | Juuti |
| 4,016,953 | A | 4/1977 | Butler |
| 4,083,426 | A | 4/1978 | Peugh |
| 4,268,719 | A | 5/1981 | Manger |
| 4,323,138 | A | 4/1982 | Horner |
| 4,616,731 | A | 10/1986 | Robinson |
| 4,665,549 | A | 5/1987 | Eriksson et al. |
| 4,875,546 | A | 10/1989 | Krnan |
| 4,923,031 | A | 5/1990 | Carlson |
| 4,923,032 | A | 5/1990 | Nuernberger |
| 4,924,963 | A | 5/1990 | Polk |
| 5,025,886 | A | 6/1991 | Jung |
| 5,073,945 | A | 12/1991 | Kageyama et al. |
| 5,119,431 | A | 6/1992 | Hamby |
| 5,143,169 | A | 9/1992 | Ziegenberg et al. |
| 5,170,435 | A | 12/1992 | Rosen et al. |
| 5,206,465 | A | 4/1993 | Jung |
| 5,296,656 | A | 3/1994 | Jung |
| 5,359,158 | A | 10/1994 | Queen |
| 5,451,726 | A | 9/1995 | Haugum |
| 5,475,764 | A | 12/1995 | Polk |
| 5,701,358 | A | 12/1997 | Larsen et al. |
| 5,850,460 | A | 12/1998 | Tanaka et al. |
| 6,035,051 | A | 3/2000 | Sato |
| 6,219,426 | B1 | 4/2001 | Daniels et al. |
| 6,339,649 | B1 | 1/2002 | Chen et al. |
| 6,628,792 | B1 | 9/2003 | Paddock |
| 6,628,793 | B1 | 9/2003 | Porzilli et al. |
| 6,798,891 | B1 | 9/2004 | Sadaie et al. |
| 2004/0008857 | A1 * | 1/2004 | Marnie ..... 381/397 |

* cited by examiner

*Primary Examiner* — Tuan D Nguyen
(74) *Attorney, Agent, or Firm* — TraskBritt

(57) ABSTRACT

Described is a vented speaker driver assembly utilizing a speaker driver having a pole piece that defines therein a vent that is not covered by a dust cap. The frame of the speaker driver is configured to be mounted to a structure's surface such that the pole piece of the driver is located within the structure's interior space. The vented speaker driver is configured to be utilized in a back-to-back vented driver assembly wherein the sound of more than one speaker driver is achieved in a footprint of only one driver and with minimized generation of physical vibrations from the assembly.

16 Claims, 12 Drawing Sheets

OPPOSING DUAL-VENTED WOOFER SYSTEM

FIELD OF THE INVENTION

The invention generally relates to a speaker driver assembly and more particularly to a dual-driver speaker assembly with minimized vibration generation for installation within a structure, such as a container or baffle application.

BACKGROUND OF THE INVENTION

Speakers convert electrical signals to sound via the use of drivers. A conventional driver for a speaker assembly is shown in FIGS. 1 and 2. Some such common, traditional drivers 1 include a basket or frame 12 having a general cone shape, and the frame 12 supports a lightweight diaphragm 18. The diaphragm 18 is attached to the basket or frame 12 via a surround 20 along a wide edge 16 of the frame 12 and via a spider 22 along a narrow edge 14 of the frame 12. Attached to the diaphragm 18 is a wire voice coil 40 wound surrounding a pole piece 38 that sits at the center of a disc-shaped magnet 28 that is sandwiched between a front plate 24 and a rear plate 26.

The magnet 28 is usually polarized in the direction of the magnet's 28 thickness, e.g., with the north pole adjacent to a front face 30 of the magnet 28 and the south pole adjacent to a back face 32 of the magnet 28. This generates a magnetic flux that is dense in the gap between the top of the pole piece 38 and the front plate 24. The voice coil 40 is arranged to be located within this gap between the pole piece 38 and the metal front plate 24. An electrical signal is applied to the voice coil 40, which in turn makes the voice coil 40 an electromagnet and produces a magnetic field. The voice coil's 40 magnetic field interacts with the magnet 28 and metallic front plate 24 and metallic rear plate 26 so as to generate a mechanic force that causes the voice coil 40 to move forward or backwards, or, as the case may be, upwards or downwards, depending upon the signal sent to the voice coil 40. The physical vibrating motion of the voice coil 40 causes the diaphragm 18, to which the voice coil 40 is connected, to move or vibrate, which vibration produces audible sounds.

As shown in FIGS. 1 and 2, a conventional driver 1 further includes a dust cap 3 that covers the pole piece 38, which is, itself, an essentially-cylindrically-shaped metallic part. Further, these conventional drivers 1 are commonly generally thick, e.g., on the order of three-to-four inches in height from the wide outer edge of the frame 12 to the back of the rear plate 26, where such height defines the total thickness of the traditional driver 1. Accordingly, when installed within a structure, the single driver 1 occupies a fair amount of space within the structure and has a particular footprint. Acquiring the sound output of more than one traditional driver 1 generally requires the installation and visible footprint of more than one driver 1. Also, unless separate measures are taken to counteract the physical vibrations generated by the diaphragm 18 of the driver 1, the vibrations are apt to transfer to the structure, such as the container of baffle, in which the driver 1 is mounted, which transfer is undesirable, particularly when the structure is a wall within a household occupied by more than just the individual listening to the speaker assembly that includes the driver 1.

SUMMARY OF THE INVENTION

Embodiments of the present back-to-back vented speaker driver assembly provide for a significantly-increased output from a speaker assembly installed with a narrow depth within a structure, such as a container or baffle, with the footprint of only one speaker driver, and with minimized vibration transfer from the speaker assembly to the surrounding structure's surface. The back-to-back configuration of the assembly having dual, oppositely-directed diaphragms significantly increases the moving area produced by the assembly, compared to the moving area of a conventional driver 1. It further significantly increases the sound pressure output, compared to the sound pressure output by a conventional driver 1. Again, this increased output is accomplished with the same footprint occupied by a conventional driver 1; plus, the physical vibrations generated by the diaphragms of the assembly are effectively cancelled and therefore not transferred to the surrounding structure.

The back-to-back vented driver assembly includes a first frame section mounted to the structure surface. Connected to the first frame section is a vented pole piece and a magnet sandwiched between a front plate and a rear plate. A first voice coil is wound surrounding the vented pole piece and is connected to a first diaphragm that is supported by the first frame section. Connected to the rear plate, directly or indirectly, is a second frame section that supports a second diaphragm and a second voice coil. A second sandwiched magnet and second vented pole piece are included between the first sandwiched magnet and the second frame section, and a second voice coil is wound surrounding the second vented pole piece.

The first and second diaphragms are oppositely arranged such that while the first diaphragm moves in a first direction a certain distance, the second diaphragm is configured to move in an opposite direction an equal distance. Accordingly, the physical vibrations generated by each diaphragm are effectively cancelled by the equal and opposite physical vibrations of the other diaphragm. Therefore, the structure is minimally impacted or not impacted at all by the physical vibrations generated in the speaker driver assembly.

A barrier covers the far end of the second frame section and thereby defines an interior driver space within the speaker driver assembly. The sound produced by both voice coils is directed out into the listening area both directly, due to the first, outwardly-directed driver, and via the vents in the pole piece or pieces used, due to the barrier-covered, second, inwardly-directed driver. Further, the interior driver space within the assembly is isolated from the interior of the structure via the barrier. Thus, air or sound pressure generated within the speaker assembly dissipates into the listening area via the vented pole piece or pieces, and the air pressure generated external to the speaker assembly dissipates into the remaining areas inside the structure.

Accordingly, the back-to-back vented speaker driver assembly can be installed within a wall, occupy a relatively-narrow space within the wall, and produce the sound of more than one speaker driver in a footprint of only one speaker driver and without excessively vibrating the surrounding wall.

The purpose of the foregoing Summary is to enable the public, and especially the scientists, engineers, and practitioners in the art who are not familiar with patent or legal terms or phraseology, to determine quickly, from a cursory inspection, the nature and essence of the technical disclosure of the application. The Summary is neither intended to define the invention of the application, which is measured by the claims, nor is it intended to be limiting as to the scope of the invention in any way.

Still other features and advantages of the claimed assembly will become readily apparent to those skilled in the art from the following detailed description describing preferred embodiments of the assembly, simply by way of illustration of the best mode contemplated by carrying out the assembly. As will be realized, the assembly is capable of modification in various obvious respects all without departing from the invention. Accordingly, the drawings and description of the preferred embodiments are to be regarded as illustrative, and not restrictive.

DESCRIPTION OF THE PREFERRED EMBODIMENTS

Figure 1:
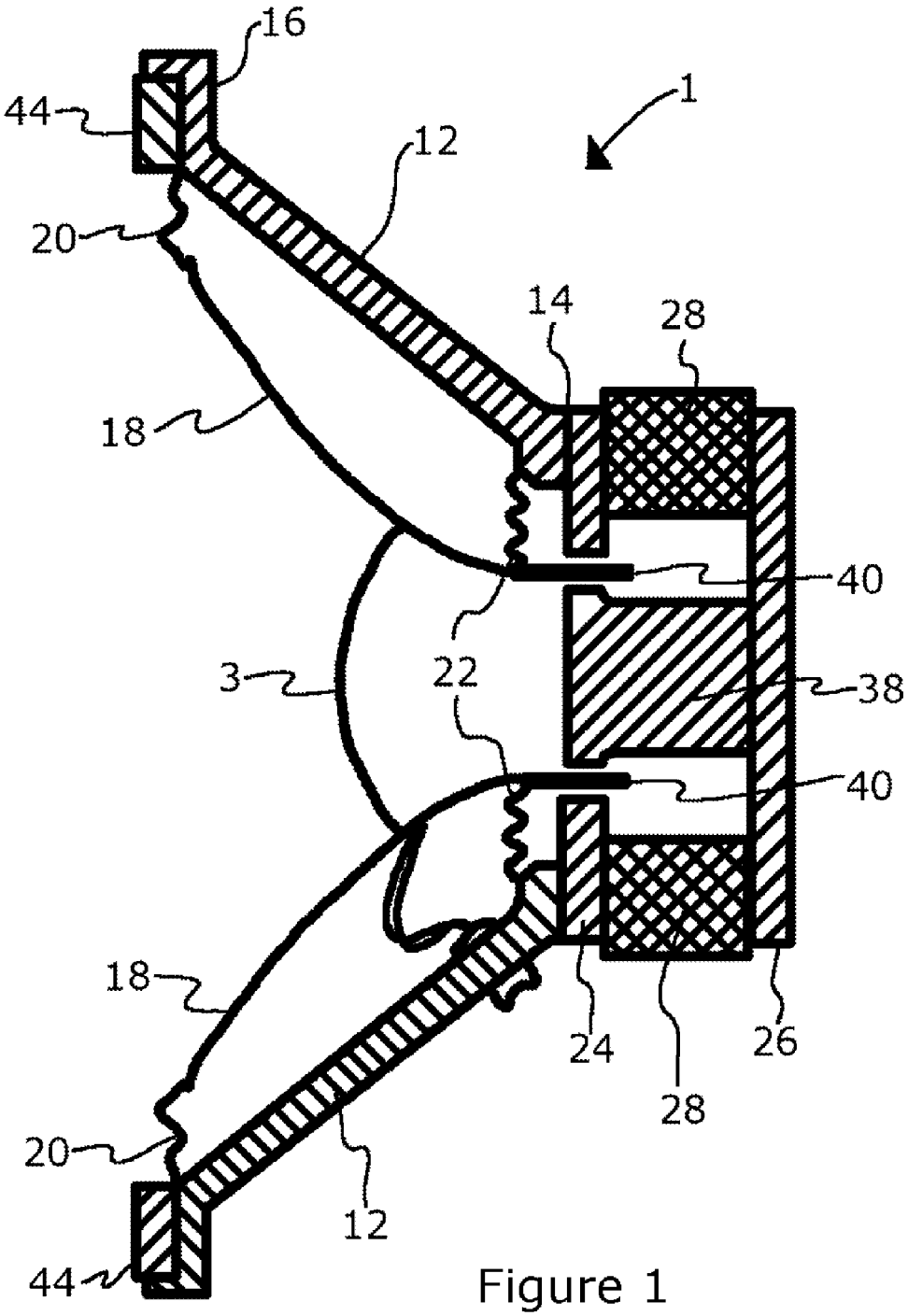
Figure 1 (RELATED ART)
FIG. 1 is a side, cross-sectional, elevation view of a conventional speaker driver.
Figure 2:
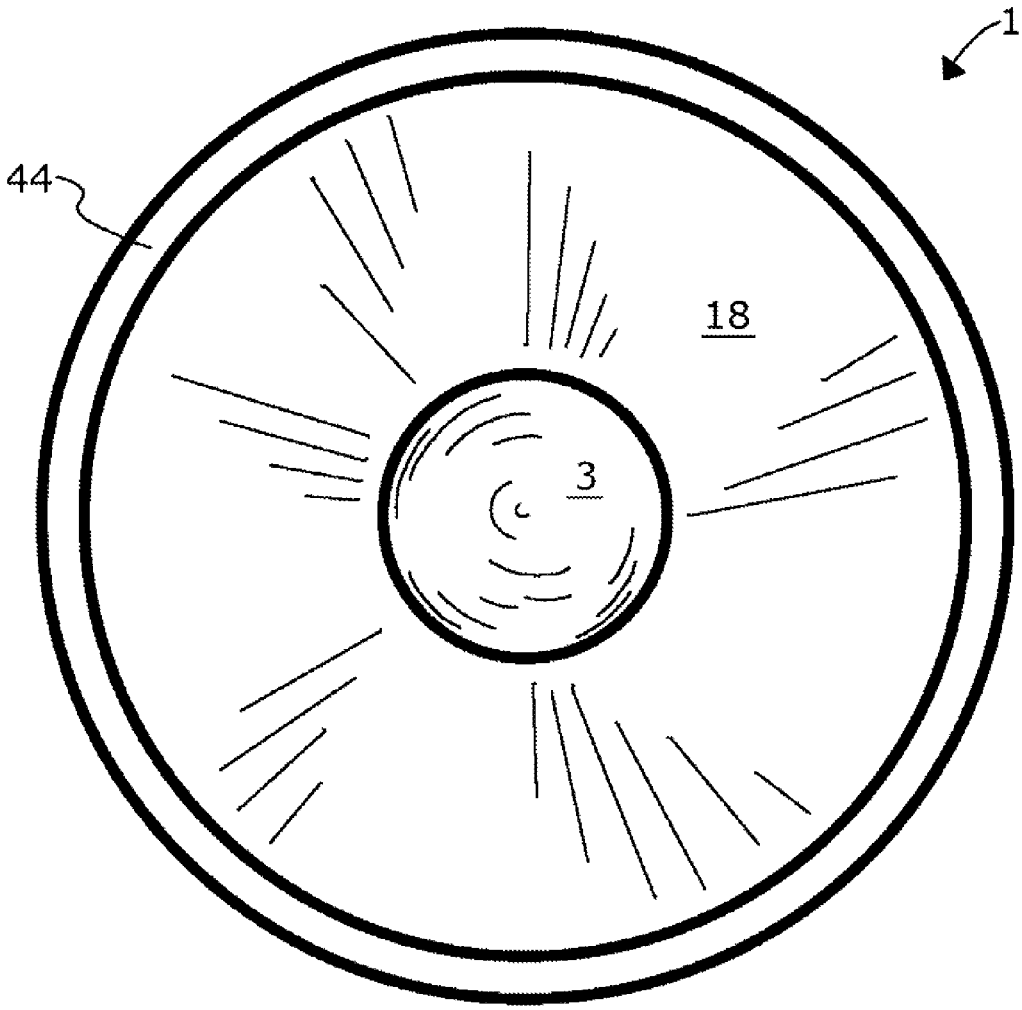
Figure 2 (RELATED ART)
FIG. 2 is a front, elevation view of a conventional speaker driver.

While the assembly is susceptible to various modifications and alternative constructions, certain illustrated embodiments thereof have been shown in the drawings and will be described below in detail. It should be understood, however, that there is no intention to limit the assembly to the specific form disclosed, but, on the contrary, the assembly is to cover all modifications, alternative constructions, and equivalents falling within the spirit and scope of the invention as defined in the claims.

As shown in FIGS. 3 through 12, for purpose of illustration, the back-to-back vented speaker driver assembly is embodied in an assembly configured to be mounted within a structure space, such as a container space or baffle space, and that provides the effective output of more than one speaker driver in a footprint of only one driver. The vented speaker assembly utilizes a vented pole piece that is not covered by a dust cap to communicate between an interior driver space and the listening space. The interior driver space is isolated from the structure interior space. The back-to-back, oppositely-directed arrangement of the speaker assembly's two diaphragms results in the effective cancellation of the physical vibrations produced by each diaphragm, thereby minimizing the physical vibrations transferred to the structure surface, such as the container surface or baffle surface.

In the following description and in the figures, like elements are identified with like reference numerals. The use of "e.g.," "etc.," and "or" indicates non-exclusive alternatives without limitation unless otherwise noted. The use of "including" means "including, but not limited to," unless otherwise noted.

FIGS. 3 through 10 depict a first embodiment of a back-to-back vented speaker driver assembly 8. The back-to-back vented speaker driver assembly 8 comprises at least one vented driver 10, which includes a rear plate 26 that supports a magnet 28. The magnet 28 has a front face 30 and back face 32, where the back face 32 rests against the rear plate 26 and the front face 30 is at least partially covered by a front plate 24. As such, the magnet 28 is layered between the rear plate 26 and the front plate 24. According to the depicted embodiment, the magnet 28 is disc-shaped. In other embodiments, the magnet 28 is shaped other than as a disc. The front plate 24 is supported on top of the magnet 28. Both the rear plate 26 and the front plate 24 are also disc-shaped, according to the depicted embodiment.

A pole piece 38 is supported by the rear plate 26 and is centralized within the front plate 24, magnet 28, and rear plate 26. According to the depicted embodiment, shown in FIG. 3, the pole piece 38 is shaped essentially as a tall disc with a lip 39 extending from the upper edge of the pole piece 38. In other embodiments, the pole piece 38 is shaped essentially as a ring. The pole piece 38 defines therein a vent 42 that passes through the pole piece 38. This vent 42 is not covered by a dust cap 3. The pole piece 38 is arranged central to the front plate 24 such that a gap is left between the pole piece 38 and the front plate 24. A voice coil 40 is situated within the gap between the pole piece 38 and the front plate 24, which voice coil 40 is supported by a diaphragm 18. The diaphragm 18 is supported by a frame 12 that is connected to the rear plate 26, either directly or indirectly. According to the first embodiment, shown in FIG. 3, the frame 12 is connected to the rear plate 26 indirectly, by means of being directly attached to the front plate 24, which is supported by the rear plate 26.

The frame 12 has a first edge and a second edge, or, alternatively, an inner edge and an outer edge. The first edge, or, alternatively, the inner edge, is supported by the front plate 24, and a mounting surface 44 is included along the second edge, or, alternatively, the outer edge, of the frame 12. According to the depicted embodiment, shown in FIG. 3, the first edge of the frame 12 is a narrow edge 14 that is attached to the front plate 24. Also according to the depicted embodiment, the second, outer edge of the frame 12 is a wide edge 16 that includes a mounting surface 44 configured to be mounted to a structure surface 48 such as a container surface or baffle surface. A diaphragm 18 is supported by the frame 12. According to the depicted embodiment, the diaphragm 18 is supported by the frame 12 via a surround 20 near the wide edge 16 of the frame 12 and via a spider 22 near the narrow edge 14 of the frame 12.

For use, the mounting surface 44 of the vented driver 10 is mounted to a surface 48, such as the surface of a structure, such as a wall, a ceiling, a cabinet, another type of container, or a baffle. As mounted, therefore, the frame 12 supports the other parts of the vented driver 10 as the vented driver 10 is recessed within the interior of the structure, such as the interior of a container or the interior space defined by a baffle.

Figure 3:
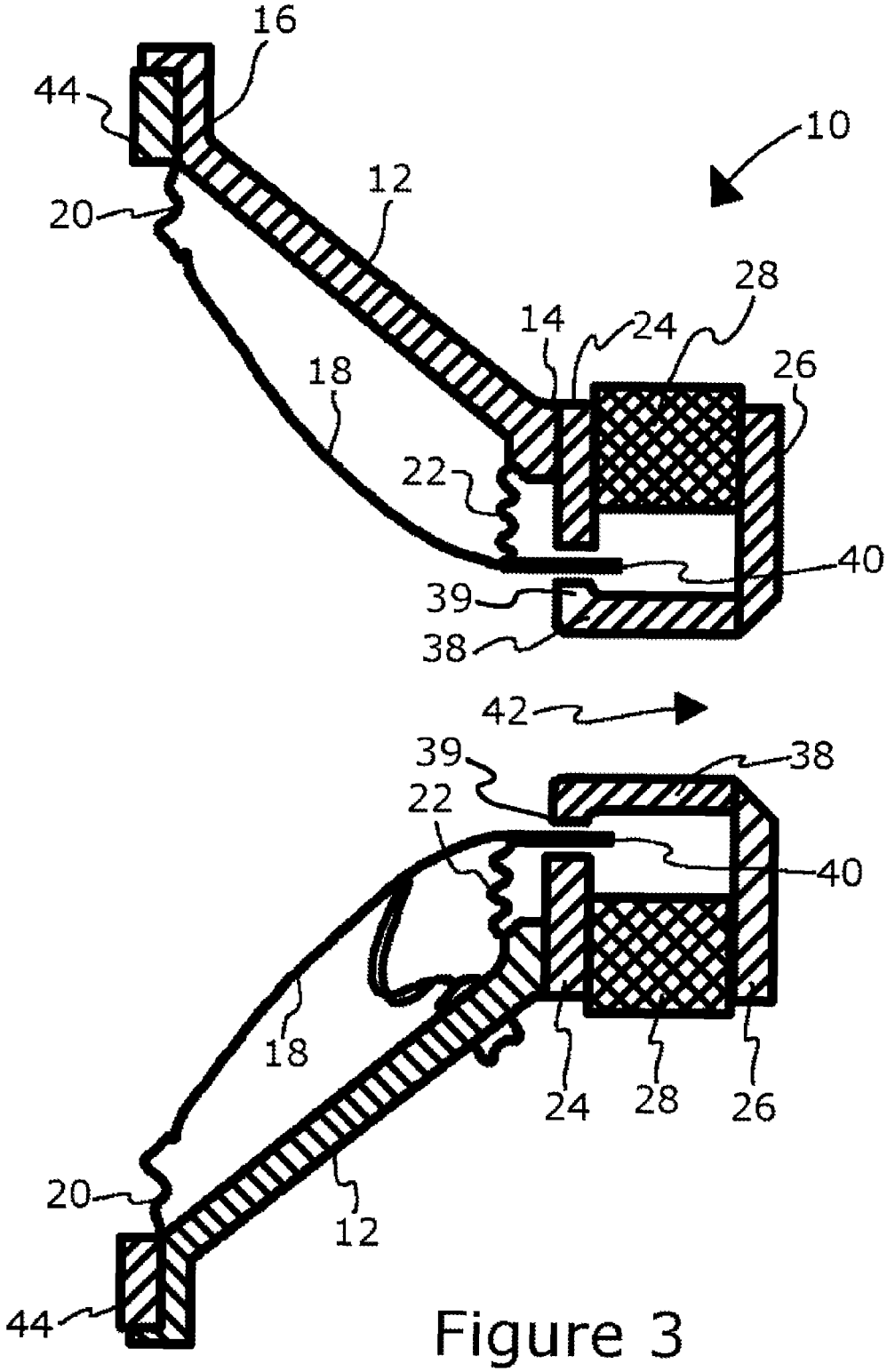
FIG. 3 is a side, cross-sectional, partial, elevation view of a vented driver according to a first embodiment.
Figure 4:
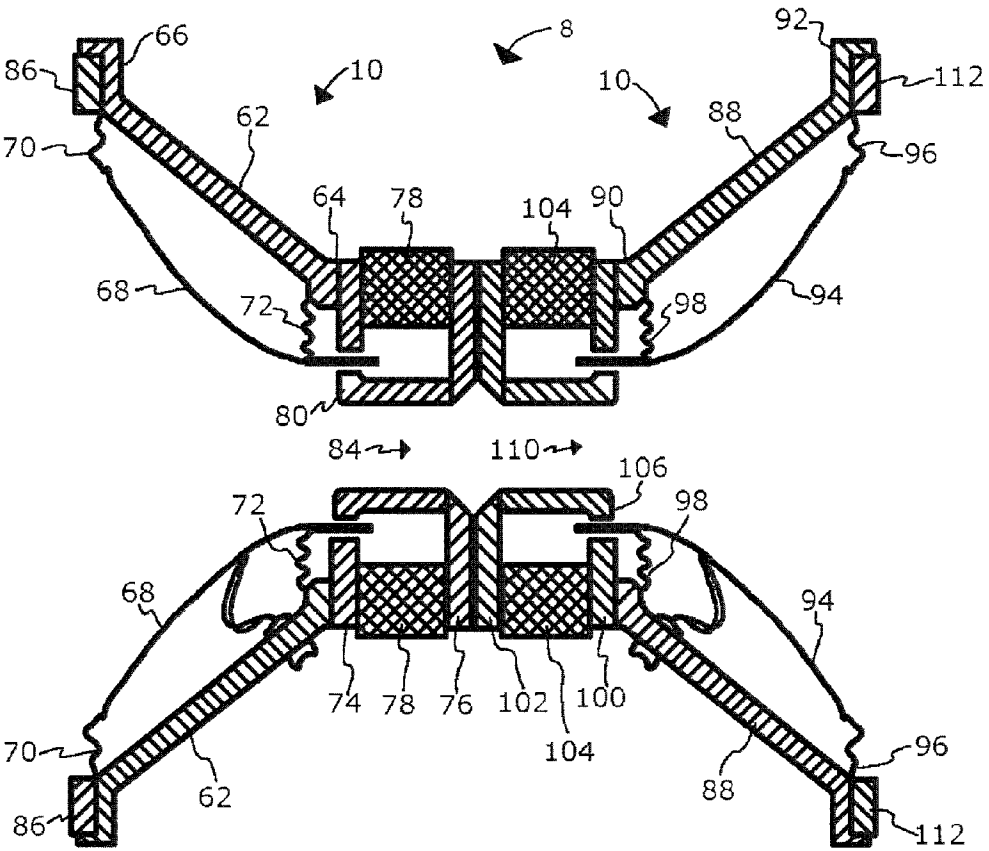
FIG. 4 is a side, cross-sectional, partial, elevation view of a back-to-back vented speaker driver assembly according to a first embodiment, without a barrier included.

According to the first depicted embodiment, shown in FIG. 4, the back-to-back vented speaker driver assembly 8 includes two, essentially identical, back-to-back, oppositely-directed vented drivers 10. As such, the back-to-back vented speaker driver assembly 8 includes a first frame 62 having a first narrow edge 64 and a first wide edge 66 with a first diaphragm 68 supported by the first frame 62 via a first surround 70 and first spider 72. The first frame 62 is connected to a first front plate 74, which rests atop a first magnet 78, which in turn is supported by a first rear plate 76. A first pole piece 80 is also supported by the first rear plate 76 and defines a first vent 84 through the first pole piece 80. This first vented driver 10 is equivalent to the vented driver 10 depicted in FIG. 3.

A second vented driver 10, also equivalent to the vented driver 10 depicted in FIG. 3, is arranged back-to-back and oppositely directed to the first vented driver 10, as shown in FIG. 4. As such, the second vented driver 10 includes a second frame 88 having a second narrow edge 90 and second wide edge 92 with a second diaphragm 94 supported by the second frame 88 via a second surround 96 and second spider 98. The second frame 88 is connected to a second front plate 100, which rests atop a second magnet 104, which in turn is supported by a second rear plate 102. A second pole piece 106 is also supported by the second rear plate 102 and defines a second vent 110 through the second pole piece 106.

The second rear plate 102, itself, is supported by the first rear plate 76 of the first vented driver 10. In some embodiments, the first rear plate 76 and second rear plate 102 are two, joined, individual, metallic plates. In other embodiments, the first rear plate 76 and second rear plate 102 form a unified, singular, metallic plate. When a first mounting surface 86 is mounted to the structure surface 48 such as a container or baffle surface, the first pole piece 80 of the first vented driver 10 is located within a structure interior space 60, i.e., the space separated from the listening space as defined by the structure surface 48, as is the entirety of the second vented driver 10. Further, according to the first depicted embodiment, the first vent 84 of the first pole piece 80 is aligned with the second vent 110 of the second pole piece 106, thereby forming one continuous vent 42. According to the depicted embodiments, the first vent 84 and second vent 110 are identical in shape.

Figure 5:
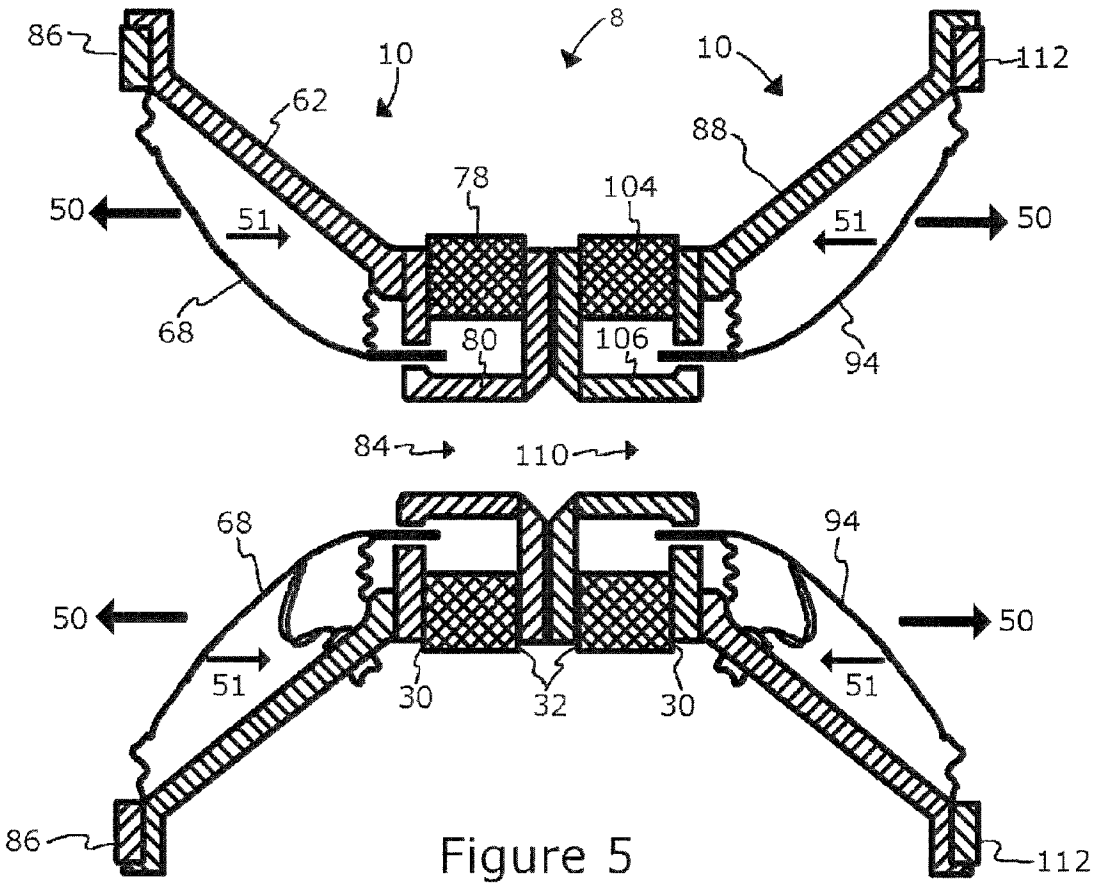
FIG. 5 is a side, cross-sectional, partial, elevation view of a back-to-back vented speaker driver assembly according to a first embodiment, without a barrier included, depicting the direction of the movement of the diaphragms.

As shown in FIG. 5, the first and second vented drivers 10 of the back-to-back vented speaker driver assembly 8 are arranged so as to be oppositely directed such that the physical movement of the first diaphragm 68 is oppositely directed to the physical movement of the second diaphragm 94. That is, the back-to-back vented speaker driver assembly 8 is arranged such that when the first diaphragm 68 and second diaphragm 94 move in a forward direction, as indicated by arrows 50, the first diaphragm 68 and second diaphragm 94 are moving essentially an equal distance in opposite directions. Likewise, when the first diaphragm 68 and second diaphragm 94 move in a backward direction, as indicated by arrows 51, the first diaphragm 68 and second diaphragm 94 are again moving essentially an equal distance in opposite directions. Accordingly, the physical vibrations generated by each of the first diaphragm 68 and second diaphragm 94 essentially cancel each other out, leaving a minimized net vibration effect to be transferred to the surrounding surface to which the back-to-back vented speaker driver assembly 8 is mounted.

Figure 6:
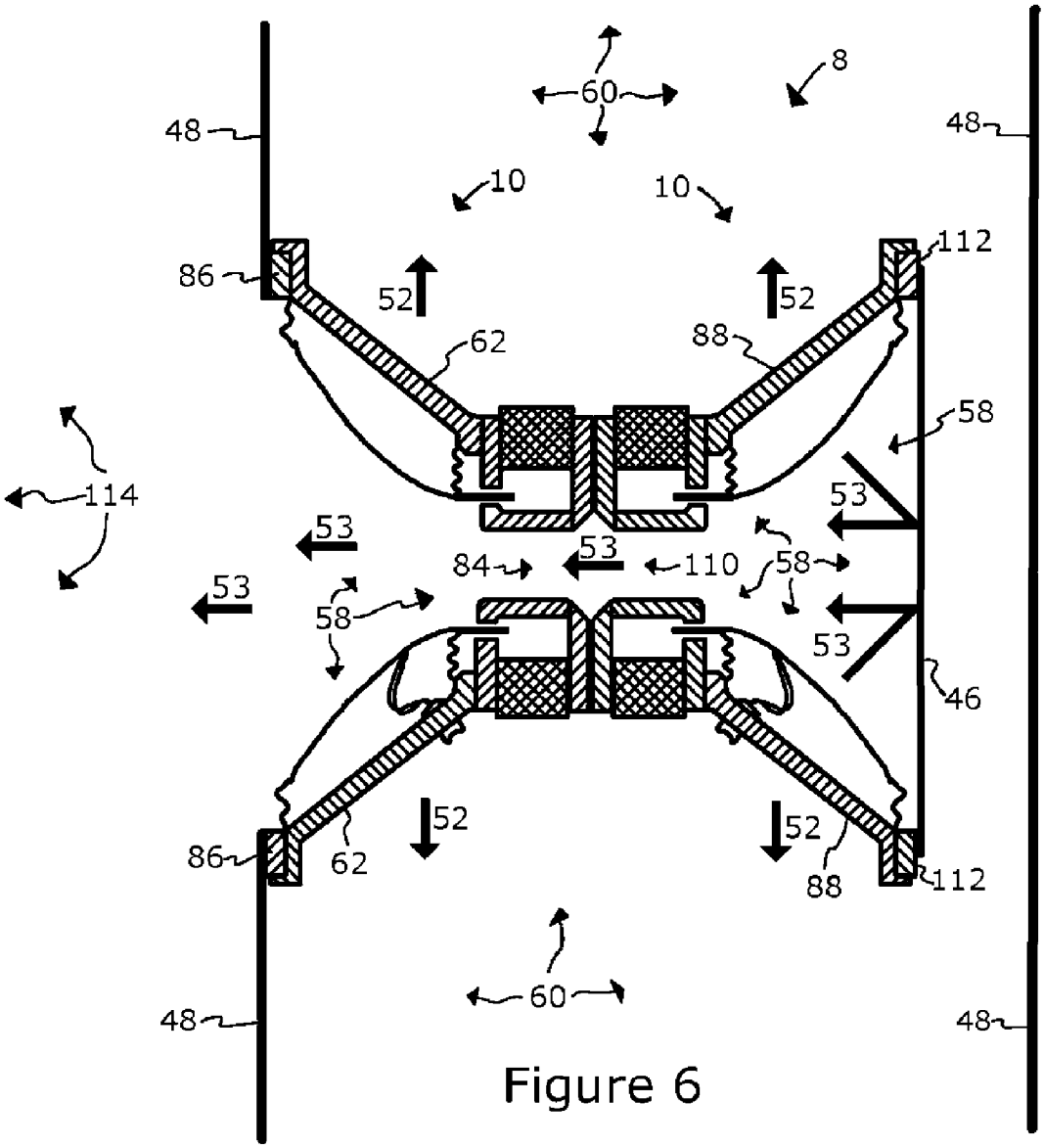
FIG. 6 is a side, cross-sectional, partial, elevation view of a back-to-back vented speaker driver assembly according to a first embodiment, mounted to a structure surface, depicting the direction of air pressure movement.
Figure 7:
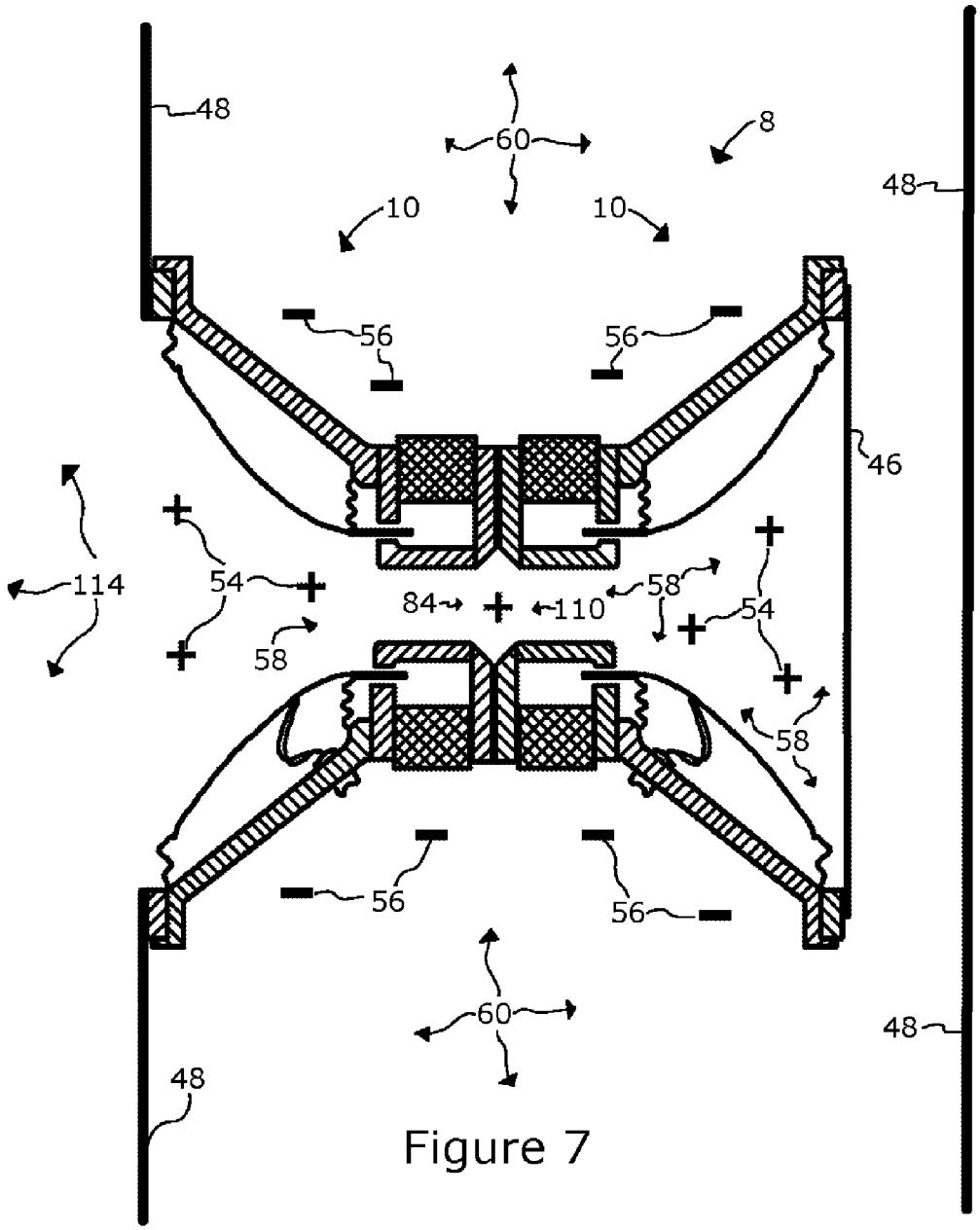
FIG. 7 is a side, cross-sectional, partial, elevation view of a back-to-back vented speaker driver assembly according to a first embodiment, mounted to a structure surface, depicting relative pressure space.

As shown in FIG. 6, the back-to-back vented speaker driver assembly 8 further includes a barrier 46 connected to a second mounting surface 112 at the second wide edge 92, or, alternatively, the outer edge of the second frame 88. As such, the barrier 46 covers the second wide edge 92 and, along with the first vented driver 10 and second vented driver 10, defines an interior driver space 58 that is isolated from the remaining structure interior space 60. Because the vented first pole piece 80 and second pole piece 106 are not covered by a dust cap, and, in some embodiments, completely uncovered in the direction of a listening area 114, the interior driver space 58 is exposed to the listening area 114 outside of the structure. Thus, the sound produced by the first vented driver 10 is directed toward the listening area 114, and the barrier 46 covering the second wide edge 92 of the second vented driver 10 directs the sound of the second vented driver 10 toward the listening area 114. Further, the dual-driver arrangement increases, by at least fifty percent, the moving area of a single driver having the same footprint. Thus, the sound output of the back-to-back vented driver assembly 8 is at least fifty percent greater than the sound output of a traditional driver 1. Likewise, the sound and air pressure within the interior driver space 58 dissipates into the listening area 114 via the venting in the first pole piece 80 and second pole piece 106, as indicated by arrows 53 in FIG. 6, while sound and air pressure external to the interior driver space 58 but within the structure interior space 60 dissipates throughout the structure's interior space 60, as indicated by arrows 52 in FIG. 6. In other words, as depicted in FIG. 7, the interior driver space 58, defined by the first and second vented drivers 10 and the barrier 46, separates a positive pressure space 54 within the back-to-back vented speaker driver assembly 8 from a negative pressure space 56 external to the back-to-back vented speaker driver assembly 8 but within the interior space 60 of the structure in which the back-to-back vented speaker driver assembly 8 is mounted.

Figure 8:
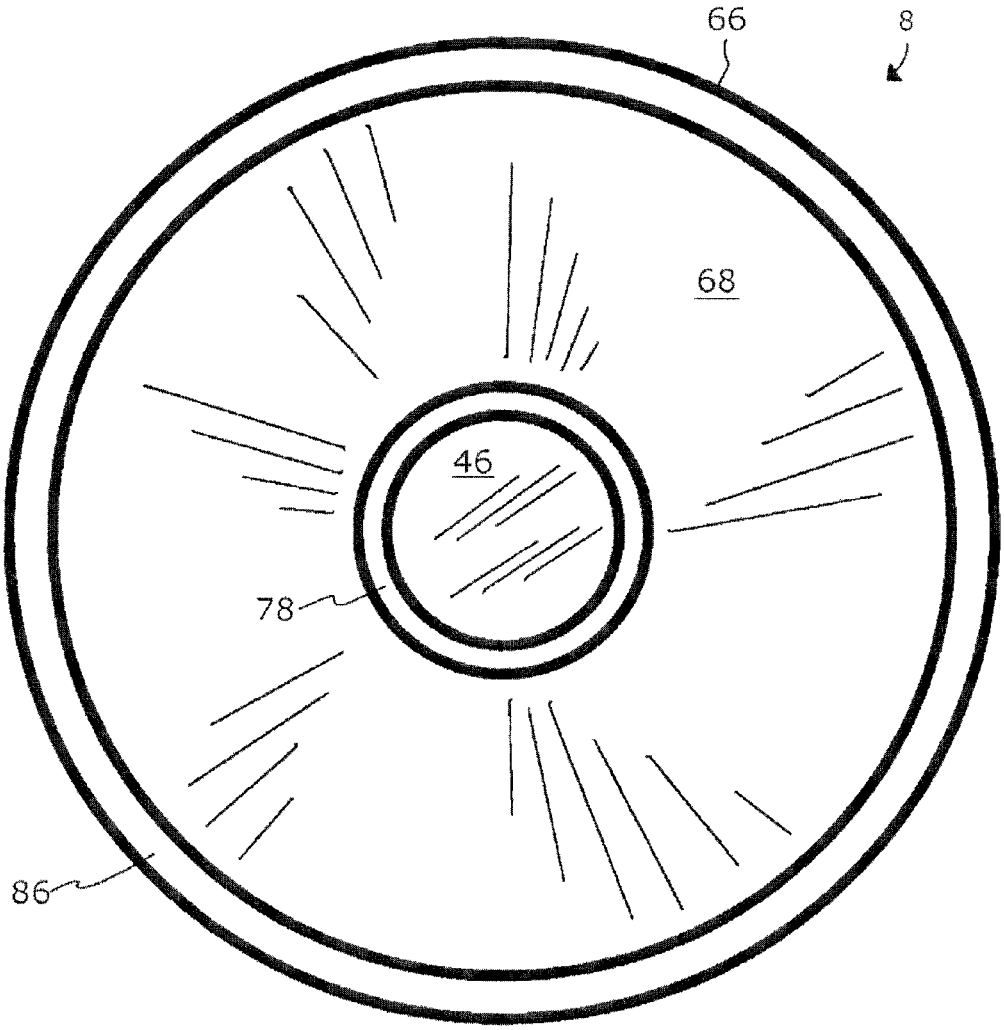
FIG. 8 is a front elevation view of a back-to-back vented speaker driver assembly according to a first embodiment.
Figure 9:
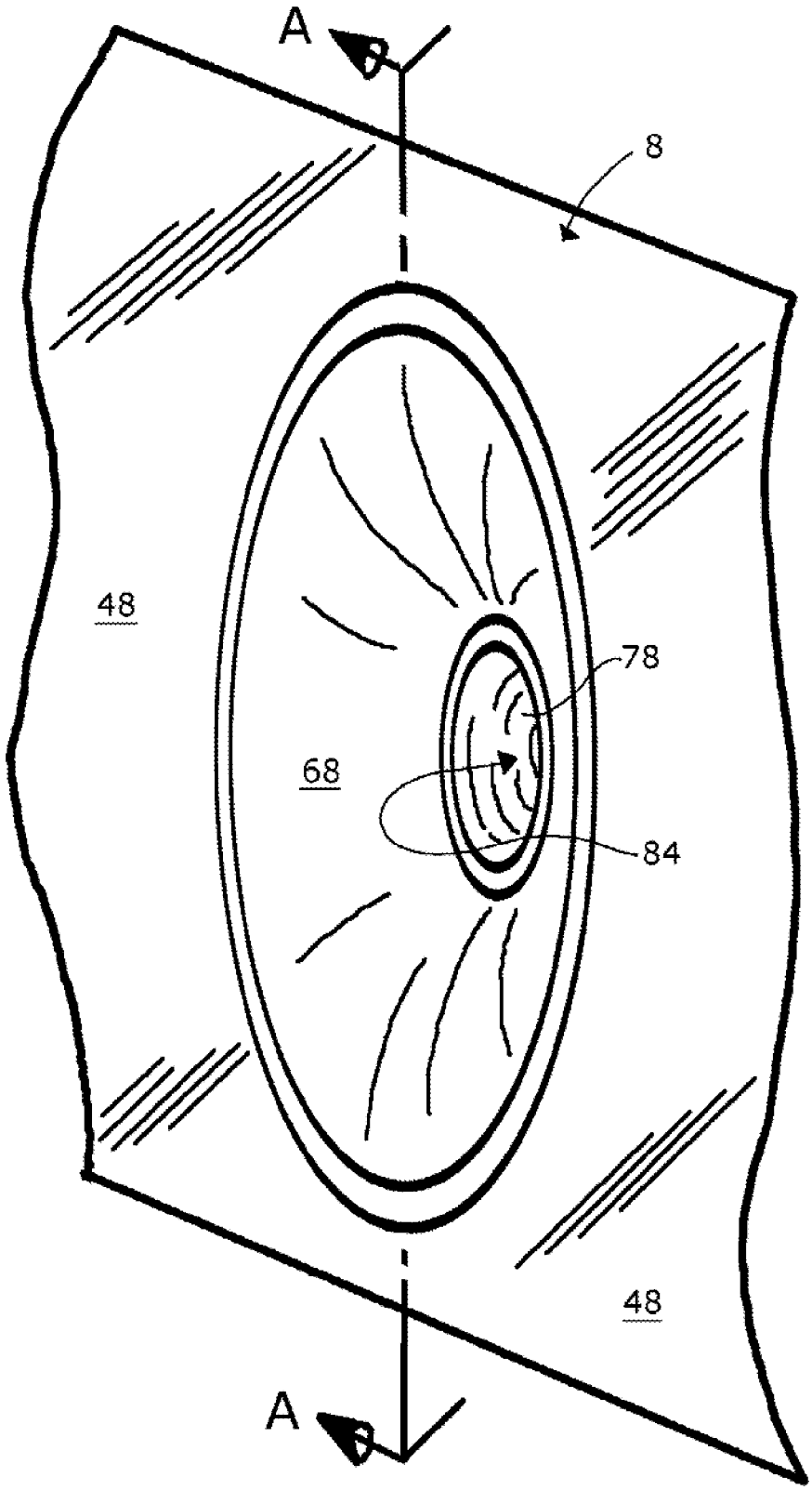
FIG. 9 is a perspective elevation view of a back-to-back vented speaker driver assembly mounted to a structure surface, according to both a first embodiment and second embodiment.
Figure 10:
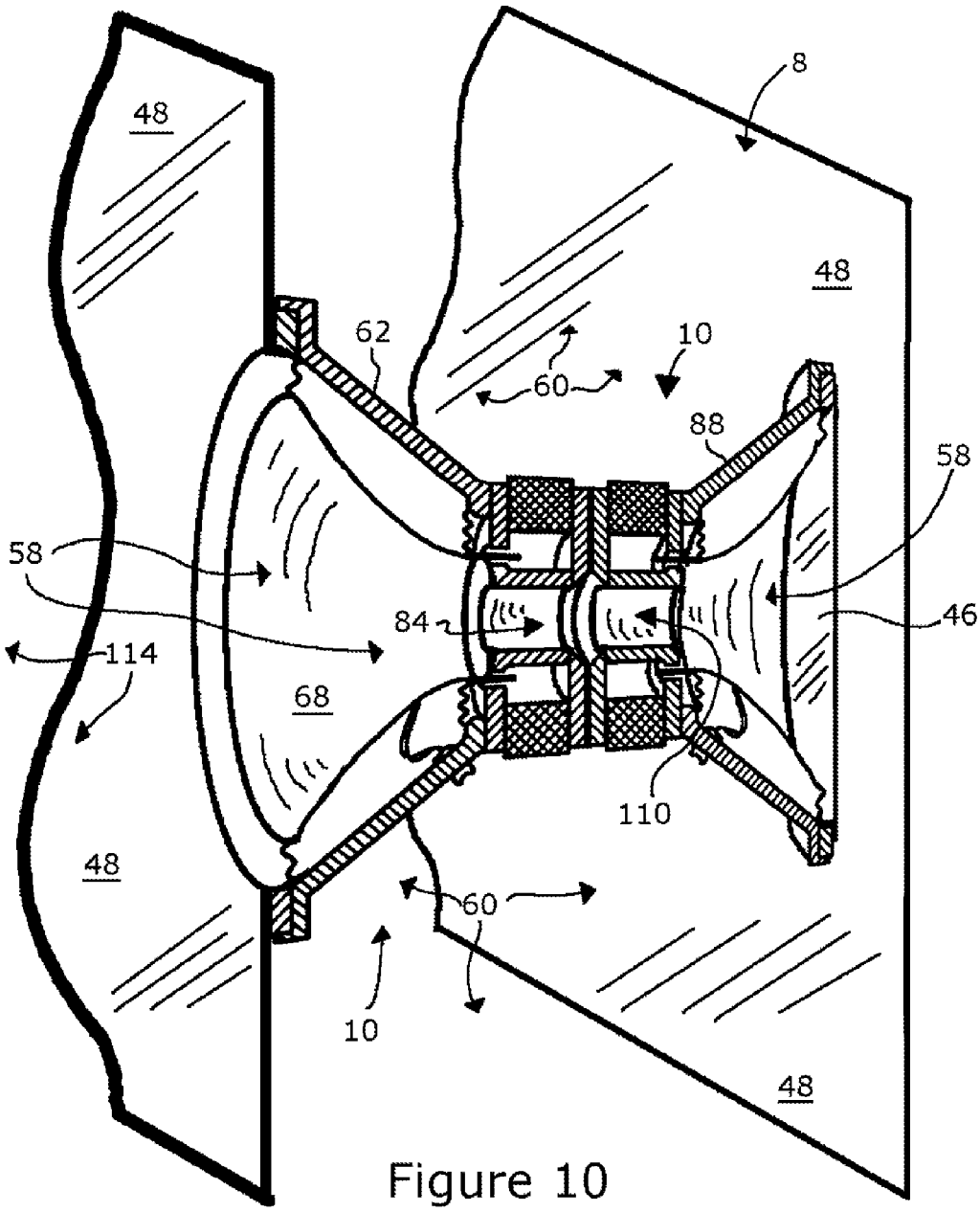
FIG. 10 is a sectional elevation perspective view, taken along plane A-A indicated in FIG. 9, of a back-to-back vented speaker driver assembly mounted to a structure surface, according to a first embodiment.

When mounted to the surface of a structure, such as a wall, container, or baffle, again, the first mounting surface 86 of the first frame 62 is configured to be mounted to the surface 48 of the structure. In some embodiments, the first mounting surface 86 of the first frame 62 is the only area of the back-to-back vented speaker driver assembly 8 directly connected to the mounted-to surface 48, as shown in FIGS. 9 and 10. Accordingly, the footprint of the back-to-back vented speaker driver assembly 8, having the effective output of significantly-more than one traditional driver 1, is the size of only a single traditional driver 1 and of only a single vented driver 10, as shown in FIG. 8. Because the first pole piece 80 and second pole piece 106 are not covered by a dust cap 3 and are, at least according to some embodiments, completely uncovered from the listening area 114, in viewing the front of the back-to-back vented speaker driver assembly 8, the barrier 46 is visible via the first vent 84 and second vent 110 through the first pole piece 80 and second pole piece 106.

Figure 11:
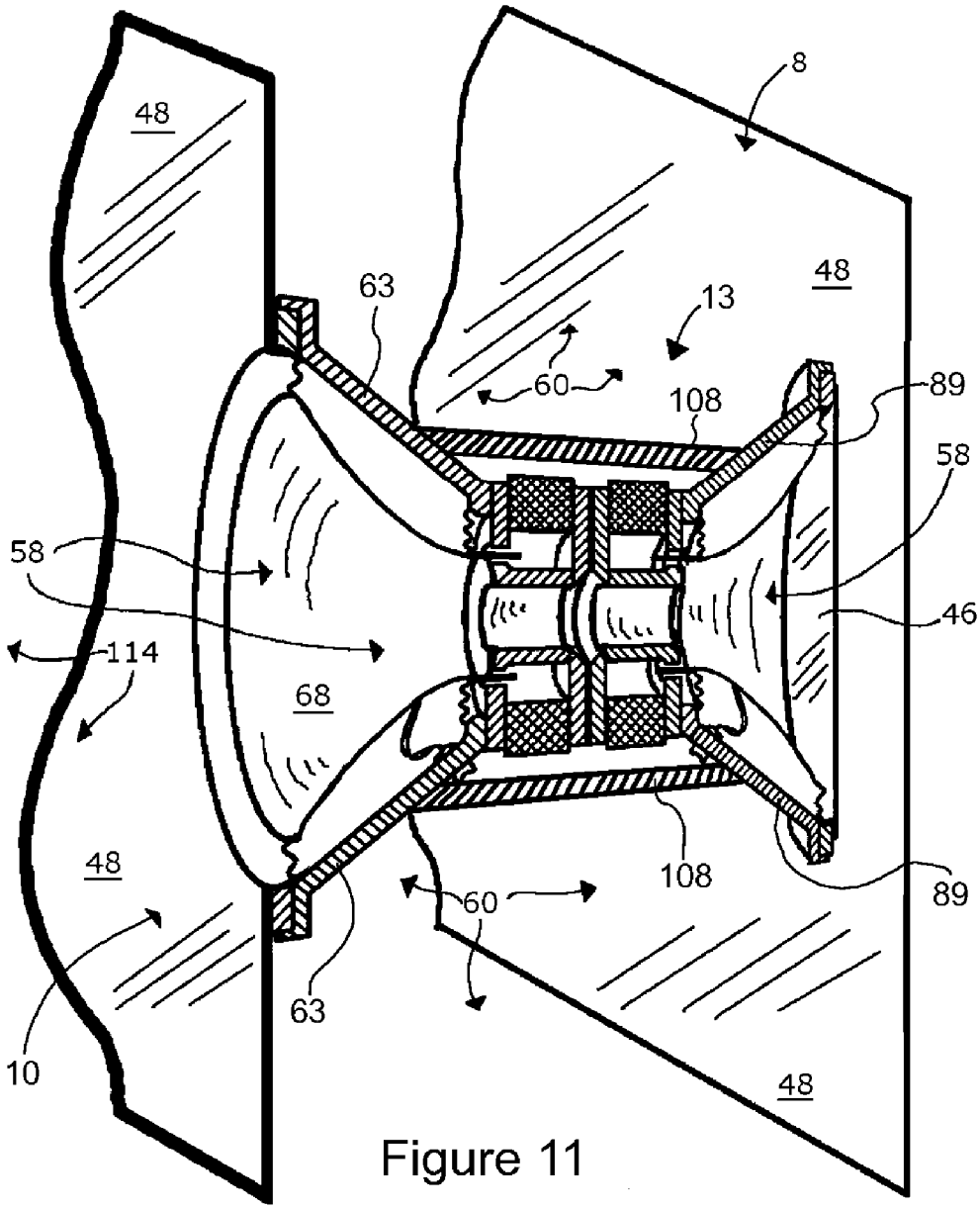
FIG. 11 is a sectional elevation perspective view, taken along a plane like plane A-A indicated in FIG. 9, of a back-to-back vented speaker driver assembly mounted to a structure surface, according to a second embodiment.
Figure 12:
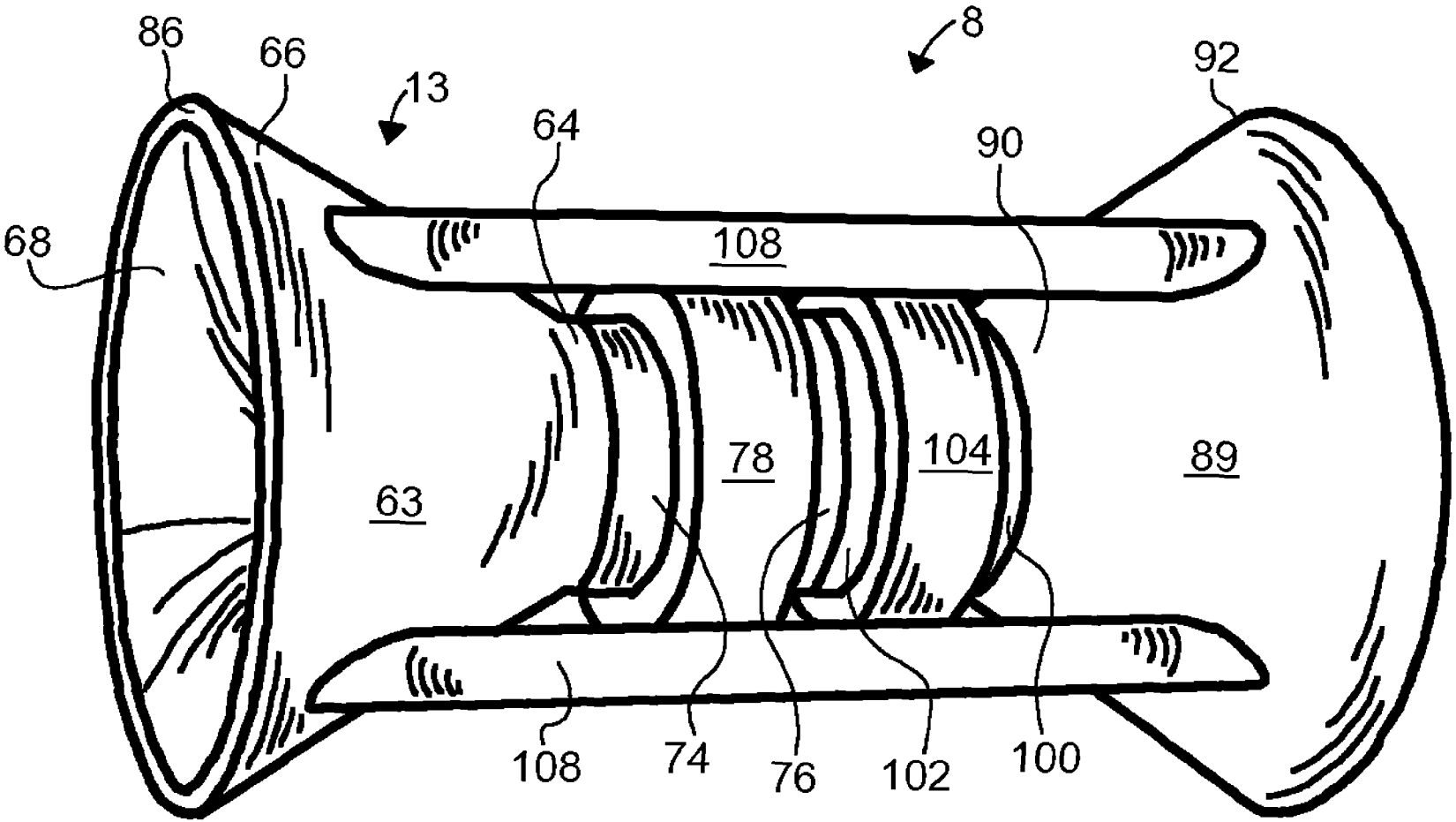
FIG. 12 is a side elevation perspective view of a back-to-back vented speaker driver assembly, not mounted to a structure surface, according to the second embodiment.

According to the second depicted embodiment, shown in FIGS. 9, 11, and 12, the back-to-back vented driver assembly 8 includes a joined, unitary frame 13 that has a first frame section 63 and a second frame section 89, which sections 63, 89 are connected to each other. According to the embodiment shown in FIGS. 11 and 12, the first frame section 63 and the second frame section 89 are connected to each other via supports 108 extending between the outer surface of the second frame section 89 to the outer surface of the first frame section 63. A first and second driver are supported by the unitary frame 13. A first diaphragm 68 is supported by the first frame section 63 via a first surround 70 and first spider 72. The first frame section 63 is connected to a first front plate 74, which rests atop a first magnet 78, which in turn is supported by a first rear plate 76. A first pole piece 80 is also supported by the first rear plate 76 and defines a first vent 84 through the first pole piece 80. The first vented driver 10 is equivalent to the vented driver 10 depicted in FIG. 3.

Also according to the second depicted embodiment, shown in FIGS. 11 and 12, a second vented driver 10, also equivalent to the vented driver 10 depicted in FIG. 3, is arranged back-to-back and oppositely directed to the first vented driver 10, as shown in FIGS. 11 and 12. The second vented driver 10 is supported by the second frame section 89 of the unitary frame 13. A second diaphragm 94 is supported by the second frame section 89 via a second surround 96 and second spider 98. A second rear plate 102 is also supported by the second frame section 89, and the second rear plate 102 supports a second pole piece 106. The second pole piece 106 defines a second vent 110 through the second pole piece 106. In some embodiments, the second rear plate 102 is directly attached to the first rear plate 76 of the first vented driver 10; while, in other embodiments, the second rear plate 102 is not directly attached to the first rear plate 76.

Also as shown in FIG. 11, a barrier 46 is connected to the outer edge of the second frame section 89. Therefore, as with the first embodiment, the barrier 46 covers the second edge, the outer edge, or, depending on the embodiment, the wide edge of the second frame section 89 of the unitary frame 13. The barrier 46, along with the first vented driver 10 and second vented driver 10, defines an interior space 58 that is isolated from the remaining interior space 60 of the structure.

The exemplary embodiments shown in the figures and described above illustrate, but do not limit, the back-to-back vented speaker driver assembly 8. It should be understood that there is no intention to limit the invention to the specific form disclosed; rather, the driver assembly is to cover all modifications, alternative constructions, and equivalents falling within the spirit and scope of the invention as defined in the claims. For example, while the exemplary embodiment illustrates an assembly mounted horizontally, such that the listening area is to the side of the assembly, the assembly is not limited to being mounted in this arrangement, but may alternately be mounted so as to be directed downward, upward, or at an angle. Thus, while the assembly is not limited to being mounted within a wall or baffle, it is expected that various embodiments of the assembly will be particularly useful in such installations. Further, while it is expected that the assembly will be particularly applicable to installations of woofer drivers, the assembly could alternatively be utilized with other speaker drivers. In any regard, the foregoing description should not be construed to limit the scope of the invention, which is defined in the following claims.

Accordingly, while there is shown and described the present preferred embodiments of the assembly, it is to be distinctly understood that this assembly is not limited thereto but may be variously embodied to practice within the scope of the following claims. From the foregoing description, it will be apparent that various changes may be made without departing from the spirit and scope of the invention, as defined by the following claims.

What is claimed is:

1. A vented speaker driver configured to be mounted to a structure surface located in a listening area, the structure surface defining a structure interior space, the vented speaker driver comprising:

a frame;

a rear plate supported by the frame; and a pole piece supported by the rear plate, the pole piece defining a vent passing therethrough, the vent exposed to the listening area;

the frame configured to mount to the structure surface with the pole piece recessed within the structure interior space.

2. The vented speaker driver of claim 1, wherein the frame has a first edge and a second edge, the rear plate connected to the first edge;

the vent defines a vent diameter; and the second edge of the frame defines a frame diameter.

3. The vented speaker driver of claim 1, wherein the rear plate is configured to support a second rear plate of a second vented speaker driver comprising:

a second frame supported by the second rear plate, the second frame having an outer edge;

a second pole piece supported by the second rear plate, the second pole piece defining a second vent passing therethrough, the second vent exposed to the listening area; and a barrier covering the outer edge of the second frame.

4. The vented speaker driver of claim 1, wherein the vented speaker driver defines an interior driver space comprising the vent passing through the pole piece, the interior driver space isolated from the structure interior space.

5. A dual-driver speaker assembly configured to be mounted within a structure located in a listening area, the structure having a structure surface defining a structure interior space, the assembly comprising:

a first driver comprising:

a first frame;

a first diaphragm connected to the first frame;

a first rear plate supported by the first frame;

a first pole piece supported by the first rear plate, the first pole piece defining a first vent passing therethrough, the first vent not covered by a dust cap; and the first frame configured to mount to the structure surface in a manner wherein the first pole piece is located within the structure interior space; and a second driver comprising:

a second rear plate supported by the first rear plate;

a second pole piece supported by the second rear plate, the second pole piece defining a second vent passing therethrough, the second vent aligning with the first vent;

a second frame having a first edge and a second edge, the second frame supported by the rear plate;

a second diaphragm connected to the second frame; and a barrier supported by the second frame and covering the second edge;

the first driver, the second driver, and the barrier defining an interior driver space isolated from the structure interior space, said interior the interior driver space exposed to the listening area;

the first driver and the second driver oppositely directed;

whereby physical vibrations generated by the first diaphragm are essentially effectively cancelled by physical vibrations generated by the second diaphragm;

whereby air pressure generated within the interior driver space vents to the listening area; and whereby air pressure generated external to the interior driver space dissipates within the structure interior space.

6. The dual-driver speaker assembly of claim 5, wherein the structure is a wall.

7. The dual-driver speaker assembly of claim 5, wherein the structure is a baffle.

8. The dual-driver speaker assembly of claim 5, wherein the first frame and the second frame are essentially identical in shape.

9. The dual-driver speaker assembly of claim 5, wherein the first vent and the second vent are essentially identical in shape.

10. The dual-driver speaker assembly of claim 5, wherein:

the first frame includes a first mounting surface configured to mount to the structure surface;

a total assembly thickness is defined by the first mounting surface in relation to the barrier; and the second edge of the second frame defines a frame diameter.

11. The dual-driver speaker assembly of claim 5, wherein:

the first edge is a narrow edge; and the second edge is a wide edge.

12. A dual-driver speaker assembly configured to be mounted within a structure or located in a listening area, the structure having a structure surface defining a structure interior space, the assembly comprising:

a unitary frame comprising:

a first frame section; and a second frame section attached to the first frame section, the second frame section having an inner edge and an outer edge; and a first driver supported by the unitary frame, the first driver comprising:

a first diaphragm connected to the first frame section;

a first rear plate supported by the first frame section; and a first pole piece supported by the first rear plate, the first pole piece defining a first vent passing therethrough, the first vent not covered by a dust cap;

the first frame section configured to mount to the structure surface in a manner wherein the first pole piece is located within the structure interior space; and a second driver supported by the unitary frame, the second driver comprising:

a second diaphragm connected to the second frame section;

a second rear plate supported by the second frame section;

a second pole piece supported by the second rear plate, the second pole piece defining a second vent passing therethrough, the second vent aligning with the first vent; and a barrier supported by the second frame section and covering the outer edge of the second frame section;

the first driver, the second driver, and the barrier defining an interior driver space isolated from the structure interior space, the interior driver space exposed to the listening area;

the first driver and the second driver oppositely directed;

whereby physical vibrations generated by the first diaphragm are essentially effectively cancelled by physical vibrations generated by the second diaphragm; and whereby air pressure generated within the interior driver space vents to the listening area; and whereby air pressure generated external to the interior driver space dissipates within the structure interior space.

13. The dual-driver speaker assembly of claim 12, wherein the structure is a wall.

14. The dual-driver speaker assembly of claim 12, wherein the structure is a baffle.

15. The dual-driver speaker assembly of claim 12, wherein the first frame section has a mounting edge configured to mount the dual-driver speaker assembly to the structure surface.

16. The dual-driver speaker assembly of claim 15, wherein the second frame section is attached to the first frame section via at least one support extending between the second frame section and the first frame section.

* * * * *